US008896647B2

(12) United States Patent
Goldau et al.

(10) Patent No.: US 8,896,647 B2
(45) Date of Patent: Nov. 25, 2014

(54) METHOD AND DEVICE FOR PRODUCING COLOUR IMAGES BY WAY OF A UV LASER ON PIGMENTED SUBSTRATES, AND PRODUCTS PRODUCED AS A RESULT

(75) Inventors: Rainer Goldau, Zurich (CH); Klaus Schafer, Zurich (CH)

(73) Assignee: U-NICA Technology AG, Malans (JP)

( * ) Notice: Subject to any disclaimer, the term of this patent is extended or adjusted under 35 U.S.C. 154(b) by 0 days.

(21) Appl. No.: 13/883,591

(22) PCT Filed: Sep. 20, 2011

(86) PCT No.: PCT/EP2011/066358

§ 371 (c)(1),
(2), (4) Date: Jul. 19, 2013

(87) PCT Pub. No.: WO2012/062505

PCT Pub. Date: May 18, 2012

(65) Prior Publication Data

US 2013/0314486 A1 Nov. 28, 2013

(30) Foreign Application Priority Data

Nov. 8, 2010 (CH) ..... 1866/10

(51) Int. Cl.

| | |
|---|---|
| ***B41J 2/47*** | (2006.01) |
| ***B41J 2/44*** | (2006.01) |
| ***B41M 3/14*** | (2006.01) |
| *B41J 2/435* | (2006.01) |
| *B42D 15/00* | (2006.01) |
| *B41M 5/20* | (2006.01) |
| *B41M 5/24* | (2006.01) |

(52) U.S. Cl.

CPC ..... *B41J 2/442* (2013.01); *B42D 15/00* (2013.01); *B41M 3/14* (2013.01); *Y10S 462/903* (2013.01)

USPC ..... 347/232; 347/262; 283/84; 283/85; 283/86; 462/903; 503/200

(58) Field of Classification Search

CPC ..... B41J 2/442; B41J 2/435; B42D 15/00; B41M 5/28; B41M 5/34

USPC ..... 347/232, 262; 283/84–86; 462/903; 503/200

See application file for complete search history.

(56) References Cited

U.S. PATENT DOCUMENTS 3,351,948 A 11/1967 Bonn
3,842,195 A * 10/1974 Takahashi et al. ..... 358/501

(Continued)

FOREIGN PATENT DOCUMENTS

DE 29 07 004 B1 8/1980
DE 3710183 A1 10/1988

(Continued)

*Primary Examiner* — Laura Martin
*Assistant Examiner* — Jeremy Bishop
(74) *Attorney, Agent, or Firm* — Sughrue Mion, PLLC

(57) ABSTRACT

A method is described for producing a character, pattern, symbol and/or image (8) on a substrate (2) by way of pigment particles (1) which are arranged thereon and lose their color effect under the action of a laser (23), wherein different pigment particles (1) with at least three different color effects are arranged on and/or in the substrate (2). The invention is distinguished by the following method steps: (a) production of a color chart (14), in which the individual color effect of individual pigment particles (1) or individual clusters of pigment particles is contained as a function of their spatial coordinate on and/or in the substrate (2); (b) spatially resolved irradiation, which changes the color effect of only individual pigment particles (1) or individual clusters of pigment particles, by way of a laser (23) at a single frequency on the basis of the color chart (14) in order to produce a resulting color effect. Furthermore, the present invention relates to substrates, in particular security documents, produced using a method of this type, and devices for carrying out methods of this type.

21 Claims, 7 Drawing Sheets

(56) References Cited

U.S. PATENT DOCUMENTS

| | | | | | |
|---|---|---|---|---|---|
| 4,977,058 | A * | 12/1990 | Miyagawa et al. | ..... | 430/138 |
| 5,157,412 | A | 10/1992 | Kleinschmidt et al. | | |
| 5,364,829 | A | 11/1994 | Kishimoto et al. | | |
| 5,854,651 | A * | 12/1998 | Kessler et al. | ..... | 347/241 |
| 6,002,695 | A | 12/1999 | Alfrey et al. | | |
| 6,165,687 | A | 12/2000 | Reele | | |
| 6,827,283 | B2 * | 12/2004 | Kappe et al. | ..... | 235/494 |
| 6,901,236 | B2 * | 5/2005 | Saitoh et al. | ..... | 399/366 |
| 7,158,145 | B1 | 1/2007 | Fannasch et al. | | |
| 7,292,231 | B2 * | 11/2007 | Kodama et al. | ..... | 345/173 |
| 2011/0121557 | A1 | 5/2011 | Wu et al. | | |

FOREIGN PATENT DOCUMENTS

| | | | |
|---|---|---|---|
| DE | 19721688 | A1 | 9/1998 |
| DE | 199 49 542 | A1 | 4/2001 |
| DE | 10047450 | A1 | 4/2002 |
| DE | 20218444 | U1 | 1/2003 |
| DE | 10304805 | A1 | 8/2004 |
| DE | 102006034906 | A1 | 1/2008 |
| DE | 102007032903 | A1 | 1/2009 |
| DE | 102007037981 | A1 | 2/2009 |
| DE | 102009008779 | A1 | 9/2009 |
| DE | 102008034022 | A1 | 1/2010 |
| EP | 1 008 459 | A | 6/2000 |
| EP | 1501688 | A1 | 2/2005 |
| EP | 1 574 359 | A2 | 9/2005 |
| WO | 89/02832 | A1 | 4/1989 |
| WO | 89/05730 | A1 | 6/1989 |
| WO | 01/15910 | A2 | 3/2001 |
| WO | 01/36208 | A2 | 5/2001 |
| WO | 03/095226 | A1 | 11/2003 |
| WO | 2004-070667 | A2 | 8/2004 |
| WO | 2009021737 | A1 | 2/2009 |
| WO | 2009/140088 | A1 | 11/2009 |
| WO | 2010003585 | A1 | 1/2010 |

* cited by examiner

METHOD AND DEVICE FOR PRODUCING COLOUR IMAGES BY WAY OF A UV LASER ON PIGMENTED SUBSTRATES, AND PRODUCTS PRODUCED AS A RESULT

CROSS REFERENCE TO RELATED APPLICATIONS

This application is a National Stage of International Application No. PCT/EP2011/066358, filed on Sep. 20, 2011, which claims priority from Swiss Patent Application No. 01866/10, filed on Nov. 8, 2010, the contents of all of which are incorporated herein by reference in their entirety.

TECHNICAL FIELD

The present invention relates to methods for improved production of colour images which are protected from forgery on substrates, devices for carrying out such methods and products produced using such methods, such as in particular secured documents such as for example personalisation pages for passports, identity cards and other official cards etc.

PRIOR ART

Data carriers in the form of official cards, personalisation pages or inlays for passports or also credit cards and similar plastic cards must these days have a high level of security against forgery. There is a multiplicity of very different security features and special printing methods, which can ensure such security against forgery to a certain extent. A great challenge is not only to provide individualised security features, but in particular security features which are to a certain extent combined with the personalisation and are a respective part thereof.

For example, it is e.g. known from DE-A-2907004 that images in official cards, but of course also other visually recognisable information such as characters, patterns etc., can be produced with a laser beam. In the said document, the functional layer, from which the final image or any desired visible symbol or character is produced during the functional layer extends over the card on an area segment on which the image or other visually recognisable information will subsequently be situated. The functional layer is usually joined to other plastic layers, from which the finished card is produced as a film laminate during card production. The image is in this case burned in, the intensity of the laser beam bringing about a darkening of the irradiated point. Black and white or grey scale images are routinely produced in this manner today. The already recognised advantage of the said "laser engraving" consists in the high degree of security against forgery and resistance to light and mechanical stress of cards produced in this manner, especially if they consist of polycarbonate. This is demonstrated for example by EP-A-1574359 or EP-A-1008459. Security documents produced with the aid of laser engraving on polycarbonate laminates meet or even exceed international requirements for travel documents (ICAO Doc. 9303 Part III Volume I).

It is a disadvantage of the method that the changes in colour achieved in this manner only allow the production of essentially monochrome images. Thus, in addition to the change from white to black, colour changes from white to brown, pink to black and yellow to reddish brown are also known.

For obvious reasons, there is a great interest in producing high-quality colour images based on a laser-based process, and a demand for official cards produced in this manner.

A concept based on the irradiation of a plurality of colour components, e.g. colour bodies, pigments or colourings of different colour, takes account of these circumstances. The colouring components of different colour must together produce a coloured space, which consists of a plurality of, typically at least three, basic colours. For practical reasons, the basic colours cyan [C], magenta [M] and yellow [Y] are preferred. Other colours are however also conceivable. The basic colours must also have an absorption spectrum which allows interaction with coloured laser light. These are of course colours from the RGB system, with which there is in practice a partial incompatibility or non-ideal interaction between the colour components of the CMY system and the laser wavelength selected for the absorption maximum. In contrast to the above-mentioned method of carbonisation of initially non-visible components, this method discloses colouring by bleaching, that is lightening, a colour which is visible before irradiation. The substrate appears in a very dark, ideally black, tone before irradiation owing to the visible mixture of the colour components. Such a method is described for example by WO-A-01 15910. Despite the advantages potentially offered by this invention, namely further improved security against forgery by means of a coloured representation of the document owner, the method described in the said document and the products produced thereby have certain disadvantages under certain circumstances, which limit its practical value for certain applications. The disadvantages consist in the complexity of the pigment formulation in the layer(s) to be bleached on the card or data carrier. They allow a completely white or completely black image to be produced only to a limited extent. Moreover, the absorption spectra of most colour components used are created in such a manner that there is to a certain extent an undesirable interaction between one colouring component and another laser wavelength than the one desired. This effect can be problematic if pigments of different colours lie in the effective cross section of the laser beam combined from three wavelengths. This above-mentioned non-ideality between the absorption spectrum and the exciting laser wavelength manifests itself in a spectral crosstalk of the otherwise colouring-specific laser bleaching. This results in reduced image quality in the form of colour noise and a non-neutral reproduction of the colour tone. Furthermore, the adjustment and control of a plurality of coincident laser beams can in practice be demanding and cause colour and image defects if carried out incorrectly.

A possible implementation of such an irradiation device is described in WO-A-0136208. By optimising various parameters, the reduction in quality can be kept within limits. The method nonetheless remains difficult to master owing to its complexity with regard to the achievement of the required result. Finally, the method has proven comparatively expensive in practice owing to the at least three necessary laser devices and cannot be constructed simply as a compact unit together with the associated beam guidance apparatus.

The problem of the above-described method and products for colour laser bleaching ultimately consists in the fact that the production of colour images in official cards and similar articles is not always possible in a quality accepted by the market, in the required mastering of the method, in the justifiable costs and in the desired apparatus embodiments.

U.S. Pat. No. 5,364,829 relates to the field of re-writeable data carriers. Colour particles are embedded in a matrix layer consisting of a material which can be put either in a transparent state or in an opaque and therefore apparently white state with corresponding temperature control. The said colour particles are particles which can only produce a single colour and correspondingly cannot be changed in their colour effect by external effects. The appearance of the colour is to a certain extent set by the matrix, that is, the data carrier appears coloured when the matrix is put in its transparent state, and the data carrier appears white when the matrix is put in its opaque state. The change in the matrix properties to produce the colour effect is triggered by a heating head.

WO 01/36208 specifies the use of latent pigments, which can be activated correspondingly to produce different colours.

DESCRIPTION OF THE INVENTION

The invention is therefore based inter alia on the object of finding an image-producing laser method for an in particular for example card-shaped data carrier, which method allows the production of coloured images, symbols, texts, patterns etc. in the required quality. Furthermore, the invention is based on the object of realising the coloured images according to the said method with apparatus or a system which satisfies the required criteria of investment costs, operating costs, compactness and robustness of the method. At the same time, the complexity of the method and the products produced therewith ensure a high degree of security against forgery. In a manner surprising to a person skilled in the art, the invention provides a solution for these and other objects and extends to a novel method, the products produced therewith and the devices and systems necessary for carrying it out.

According to the invention, the object is achieved in that, instead of the spectral separation of the basic colours using lasers of different frequency as described in e.g. WO-A-01 15910 mentioned in the introduction, a spatially resolving method is used, using a single irradiation frequency. In a first step, the location of each pigment particle is determined and then the latter is bleached or activated in a location-specific manner by means of a laser beam with a single wavelength, preferably with a high-energy wavelength in the blue or ultraviolet spectrum. It is surprising that the microscopic analysis of all the colour components or pigment grains on the image field of a card-shaped data carrier with regard to their colour and position, the subsequent storage of this data and the corresponding control of a laser beam with a single irradiation frequency allows the production of a high-quality colour image (or corresponding coloured symbols, texts, patterns etc.) for example on a plastic laminate or another substrate with pigment particles correspondingly embedded therein or thereon.

In more general terms, the present invention relates to a method for producing a character, pattern, symbol and/or image in different colours on a substrate having pigment particles which are arranged on the said substrate and lose their colour effect under the action of a laser (or in more general terms, and also to be understood as such below, which change their colour effect under the action of a laser, it being possible for the change to be destruction of the colour effect, production of a colour effect or also a change in a colour effect), different colour particles with at least two or at least three different colour effects being arranged on or in the substrate. The method is characterised by the following method steps, it being possible for these method steps to be before or after other method steps:

a production of a colour map in which the individual colour effect is contained on or in the substrate by individual pigment particles or individual clusters of pigment particles (or the colour effect which can be produced or changed therefrom) as a function of the location coordinates thereof;

b spatially resolved irradiation with a laser at a single frequency on the basis of the coloured card, which irradiation only changes individual pigment particles or individual clusters of pigment particles in terms of the colour effect thereof (including the possibilities of destroying the colour effect, producing the colour effect and shifting the colour effect), to produce a resulting colour effect.

With regard to the pigment particles which can be used in such a method, reference is made to systems as described for example in WO-A-01 15910 and WO-A-0136208. Multicoloured characters, patterns, symbols and/or image means such that not only have black and white and grey tones therebetween, but other colours, for example built up from C, Y, M, in the latter case it being necessary for individual pigment particles to be provided for each of these three basic colours.

The invention therefore consists of a combination of the following elements:

- A spatial (geometric) separation of the colour components on the data carriers, which acts as a precursor for a security document. The geometric separation of the colour components satisfies in a preferred manner the basic requirement that each area element is only occupied by one colour component and a minimal distance exists between two colour components, i.e. overlapping or direct bordering of pigment particles or clusters of pigment particles is preferably largely avoided.
- A device and a method which find a certain colour component as a microscopically uniform entity, for example an individual pigment or a cluster, on the data carrier and can characterise it by its location coordinates and colour (or the colour to be triggered). The device makes it possible to map the total number of all the coloured components on the total area of the subsequent image by systematic movement and scanning. Alternatively, however, it is also possible to replace this information by means of areal irradiation and an areal but spatially resolved and colour-resolved detection method.
- A laser device, the beam exit optics of which can move exactly to a colour component on the basis of the known location coordinates and bleach (or activate) this colour component to a certain degree depending on the required colour intensity and also the method for carrying out the bleaching process with the said laser device.
- A programmable control system for the spatial positioning of the laser optics and the power control of the beam, so that each individual component is irradiated in a targeted manner over the entire area which is covered with pigment particles (colour components) in such a manner that an image is produced.

The elements of the invention satisfy requirements for working speed, cost-effectiveness, operation effort and reliability, to fulfil image production with the aid of the invention under industrial conditions.

A first preferred embodiment of the proposed method is characterised in that steps a and b are carried out in the same device and without manipulation or displacement of the substrate taking place in between. The determination of the colour map is actually one step in which precise positioning of the processed substrate is decisive for the success or failure of subsequent processing by the laser. Accordingly, in order to avoid calibration between steps a and b, the two steps a and b are preferably carried out in their entirety in the same device, where necessary using the same scanning device (for example a linear displacement unit).

A further preferred embodiment of the proposed method is characterised in that the device for creating the colour map and the laser optics are fixed in place and that the substrate is moved relatively to them with a linear displacement unit. This variant is recommended in particular in the case of lightweight substrates or substrates whose image field cannot be covered with a customary movable laser beam guide (mirror galvanometer).

According to the invention, in each case only one colour component should lie in the beam cone or focal area of the laser within a certain period for the bleaching process, all other colour components being situated in the shadow of the laser light during the same period. The distribution of the colour components within the area region which acts as the basis for the image can take place by application with a printing method (for example intaglio printing, relief printing, flexo etc.). Printing allows both a statistical distribution of the colour components and distribution in lines, circles or complex figures such as e.g. guilloches. A microscopic observation of the distribution of the colour components and a comparison thus makes it possible as an additional benefit to verify the distribution pattern as part of an authenticity check. It is also possible to apply or print the colour components in the form of microprint, number sequences and similar information in order to accommodate hidden additional information in the image in this manner, for example a personalisation of the owner of the document or the serial number of the document.

A further preferred embodiment is in other words characterised in that the pigment particles are arranged in a layer, preferably in a single layer, on and/or in the substrate, which itself can be a composite of layers, and are distributed substantially randomly as a function of the location coordinates. In principle the present invention differs in this respect substantially from other approaches of the prior art.

This is in contrast to solutions with which the colourings must be applied sorted by colour to a certain extent, for example in a fixedly predefined, typically regular pattern, so that the colourings can then be triggered in the knowledge of this regular arrangement (for example a succession of rectangles which are each "filled" with different colours in a plurality of lines and rows). In the procedure proposed here, the distribution of the colours or of the pigments which make them available is not predefined during the production process of the untreated substrate, and the latter can be produced in a very simple process. The colour distribution or the distribution of the pigment particles triggering the colour is not determined until the first processing step in a preparatory manner to a certain extent and is then processed correspondingly in the second production step. A method which is necessary with a defined, systematic arrangement of pigments, for example by means of a precise printing method with controlled, reproducible positioning of the matrix dots, then typically comes, in that the control system allows laser irradiation precisely according to this predefined pattern and the pattern of the irradiation follows the printed image.

This randomness of the distribution and the use of the random distribution for producing the symbols/images/characters etc. can also be used as a further security level. If, for example, the random arrangement of the pigment particles producing an image is stored in a database, the individualising information (image) is combined with a fingerprint (random distribution of the pigment particles producing the image), which allows a very high level of security, which substantially cannot be reproduced. A corresponding data carrier can be compared with the associated information in the database during a check, and the authenticity can be clearly determined.

A further preferred embodiment of the proposed method is characterised in that the different pigment particles are arranged in a layer, preferably in a single layer, on and/or in the substrate and are essentially arranged regularly in a microscopic pattern, it being possible for the microscopic pattern to be an arrangement of straight or waved lines, basic patterns or microprint. Such a microscopic pattern can for example be a specific legend (for example a denomination or similar) and can be used as an additional security feature which can only be verified with magnification means, because it is as good as non-reproducible.

A further preferred embodiment consists in carrying out the method according to a and/or b in parallel, that is, processing the substrate in sections at several locations on the image area at the same time.

The quality of a good image which has been printed or produced by laser irradiation is for example assessed by means of the sharpness impression (visually recognisable diameter ratio in the 36-ray Siemens star of d=0.1 D to d=0.001 D, preferably d=0.05 D to d=0.005 D), the breadth of the colour dynamics or the number of visually recognisable different colour tones or grey tones (5 bit to 16 bit, preferably 6 bit to 8 bit), the colour neutrality (colour proof) and the resolution (150 dpi to 1000 dpi, preferably 300 dpi to 500 dpi). With a print resolution of for example 500 dpi, all the colour components must be combined on an area of the resulting pixel size of approximately 50 μm (in diameter). For implementation in practice, the size of a colouring component or of a colour body runs to a diameter of at most 16 μm to 25 μm, depending on the print pattern. Taking into account a minimal spatial separation of the individual colour bodies, a size of 5 μm to 12 μm, preferably 8 μm to 12 μm is preferred. A grain size in these orders of magnitude can be produced by known methods.

A further preferred embodiment of the proposed method is correspondingly characterised in that the individual pigment particles have an average diameter in the range 5-15 μm, preferably in the range 8-12 μm, and that they are all arranged substantially on or in the substrate, preferably separated laterally individually. The arrangement of the particles can be in one or a plurality of planes. This in particular preferably in a manner in which the average lateral distance between two pigment particles is greater than the average diameter of the pigment particles or is greater than half the average diameter of the pigment particles. Furthermore, the beam diameter of the laser beam (the beam diameter is assumed to be at the $1/e^2$ level, i.e. approx. 13.5%) in step b is preferably no more than twice the size of the average diameter of the pigment particles. The beam diameter of the laser beam in step b is preferably in the range 5-20 μm, preferably in the range 8-15 μm, particularly preferably in the range 8-12 μm.

According to the invention, a colour body of this size should be approached by a laser beam guide in such a manner that the laser optics can assume a precise position in front of the colour body or mirror galvanometers can steer the laser beam precisely to the colour body. Furthermore, the beam diameter of the laser beam should be set at the location of the colour body in such a manner that no interaction with adjacent colour bodies can occur. When the invention is carried out, the laser beam is focussed in a suitable manner to do this. The focus cannot be less than a certain size in a diffraction-limited manner, but can easily be set in practice for example to an area having a diameter the size of the diameter of the colour bodies. The standard scientific literature shows that focussing to <1 μm is possible. The monochromatic laser beam necessary for bleaching has a wavelength which is suitable for an efficient bleaching process, preferably in the UV range. A suitable wavelength is generated for example by the frequency-tripled 1064 nm oscillation of an Nd:YVO4 laser.

U.S. Pat. No. 6,002,695 describes such a laser system. The power of such a laser should be in the range 0.2-0.5 W, and an individual pigment particle should be irradiated for a period of 0.01 to 10 ns at such a power, in order to ensure sufficient bleaching.

The positioning of laser optics over a colour body is possible with a precise linear displacement unit, as is offered for example by Heinrich Wolf, Eutin, Germany.

Before the colour bodies are lightened by laser irradiation, it is necessary to map all the colour bodies on the area occupied by colour bodies. This is carried out according to the invention for example in step a with an analytical scanning method. The determination of the position and colour of the individual colour bodies takes place for example by detecting characteristic points from the absorption or scattering spectrum of the individual colour body during white light excitation. A suitable focus diameter is approximately a sixth of the diameter of a colour body. The white light beam scans the area covered with colour bodies with the aid of the above-described linear displacement unit and can thus excite all the colour bodies on this area separately and correspondingly make them detectable, in that the scattered or transmission light is collected. The white light beam with the required focus is preferably provided by fibre optics, which can for example consist of a single, but also a bundle of oligomode fibres, e.g. with an individual fibre diameter of 10 to 15 μm. A colour body in the focus of the exciting white light beam is shown by the character of the reflected or transmitted light, which makes both the position and the colour of the colour body ascertainable. The spectral analysis of a colour body usually requires at least three characteristic values, depending on the basic colours and pigments used, which characteristic values produce a value for the basic colour of the colour body by means of a logical comparison algorithm. The characteristic values can for example be detected simultaneously by three photo diodes with suitably selected colour filters. The position of all the colour components is detected in this manner and stored to a certain extent as a map in a database. The colour map is used in the following step of laser bleaching for the two-dimensional navigation of the laser optics or of the bleaching laser beam.

Correspondingly, a further preferred embodiment of the proposed method is characterised in that, in order to carry out step a using the reflected light, the upper side of the substrate, or if transmitted light is used the underside of the substrate, is scanned, preferably using a linear displacement unit having an artificial or natural white light source and/or detection unit (for example photodiodes), wherein, preferably as a function of the location coordinates, white light is irradiated and the reflected or transmitted light is spectrally analysed as a function of the location coordinates, preferably in that the signal is determined only at least two, preferably at least three discrete frequencies, which allow a distinction between the different pigment particles arranged in the substrate, preferably using a photodiode, and in that the position and the associated colour effect of individual pigment particles or clusters of pigment particles is recorded as a data tuple in a data matrix forming the colour map. One variant of spectral analysis can also consist in a plurality of irradiations with light of different colours being carried out in rapid succession within a limited period instead of the white light. In other words, the colour of a pigment particle can also be defined with a sequence of flashes of different frequency ranges, e.g. in the colours red, green and blue. This method is used in practice in some flatbed scanners to scan a master. For the analysis of the light in this case it is possible but not absolutely necessary for the spectral analysis to be restricted to one photodiode.

A further preferred embodiment is characterised in that, in order to carry out step b, the surface of the substrate is scanned, preferably using a linear displacement unit with a laser source arranged thereon, in that the laser source is directed at individual pigment particles or clusters of pigment particles on the basis of the colour map, in order to destroy or activate the colour effect thereof individually.

The same linear displacement unit can preferably be used for steps a and b, as has been explained above.

Proceeding from the colour map determined in step a for the characters, patterns, symbols and/or image, a processing protocol for the laser or the plurality of lasers can be produced in a data processing unit in step b, wherein the said processing protocol receives the information on which individual pigment particles are to be locally influenced in their colour effect by the laser in a targeted manner, in particular destroyed in their colour effect (bleached) by the laser, as a function of the location coordinates to produce a certain macroscopic colour effect for the characters, patterns, symbols and/or image.

Methods are therefore proposed which detect extremely small particles of different colours on the microscopic level, register and store their colour and position on an image field and subject them to a subsequent selective treatment.

The primary application of the method consisting of the sub-methods of analytical scanning or colour body mapping and lightening of the colour bodies with a laser beam consists in the production of an image on a substrate, for example a plastic card, preferably a portrait image in a security document such as an image on an ID card or on a personalisation page of a passport. The sizes of the images and further specifications for the plastic carrier are described in ICAO document 9303, Part 3.

The card of colour components, for example colour bodies, pigments, colourings etc. which is produced digitally according to this invention can also be used in the context of use of a security document to verify the same. Commercially available devices such as scanners or digital microscopes are sufficient for checking the distribution pattern. In addition to the customary printers' loupes, digital microscopes and other devices, it is also possible to use electronic portable devices such as mobile telephones and the optical recording devices thereof for verification. To make this easier, specific programs (apps) which can run on the portable devices or mobile telephones can be provided, which automatically compares such a recording with the information about the data carrier stored in a database via a mobile telephone connection, a wlan connection or a remote connection, for example via the internet and correspondingly allows a statement on authenticity which is output via the mobile telephone. The digital images produced on site with these devices, for example in the form of .jpg files, give information on the authenticity of the document by comparison with the colour body map stored in a central database. The corresponding application programs can be installed both on the portable devices and on central servers. This proof is of course possible for an individual document.

Furthermore, the present invention relates to a data carrier having a character, pattern, symbol and/or image produced according to a method as described above.

According to a first preferred embodiment of such a data carrier, it is characterised in that it has been produced on the basis of a substrate with a random arrangement of the pigment particles, and that the random arrangement and its use for producing the character, pattern, symbol and/or image to increase security is stored on the data carrier and/or in a database.

Such data carriers are preferably an identification card, credit card, passport, user credentials or a name badge.

Furthermore, the present invention relates to a device for carrying out a method as described above, in particular characterised in that the device has means for fastening or at least placing a substrate in a positionally fixed manner, a first unit for determining the colour map of the substrate, and a second unit for the spatially resolved irradiation, which only changes individual pigment particles or individual clusters of pigment particles in their colour effect, with a laser at a single frequency on the basis of the colour map (14) in order to produce a resulting colour effect. The first and second units can use the same linear displacement unit.

The device therefore typically also has at least one data processing unit and at least one linear displacement unit which can be controlled in a two-dimensional manner by the said data processing unit and bears the first and/or second unit.

The invention is based inter alia on the insight of mapping individual pigments in a colour map and then activating these individual pigments, which are also different in terms of their colour-changing properties, individually with a laser at a single frequency. Further embodiments are specified in the dependent claims.

BRIEF DESCRIPTION OF THE DRAWINGS

Preferred embodiments of the invention are described below on the basis of the drawings, which merely serve for explanation and must not be interpreted as limiting. In the drawings.

DESCRIPTION OF PREFERRED EMBODIMENTS

Figure 1A:
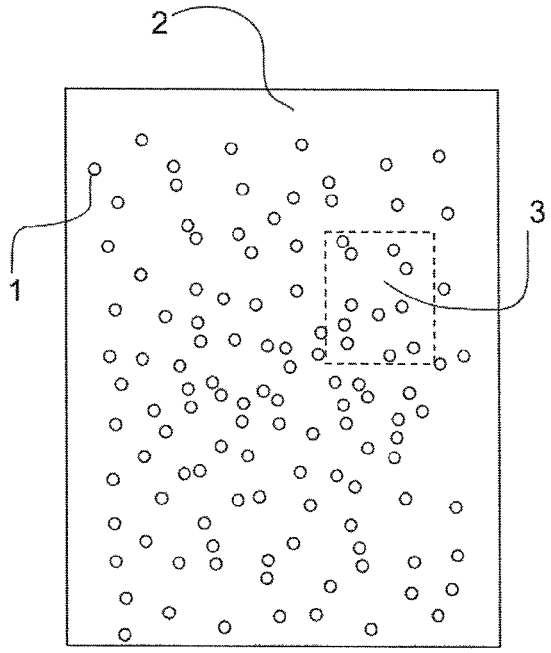
FIG. 1 shows a schematic representation of possible pigment distributions on substrates, a) showing a statistical distribution, b) showing a distribution in lines, c) showing a distribution in meanders, d) showing a circular repeating distribution and e) showing a distribution in the form of microprint.
Figure 1B:
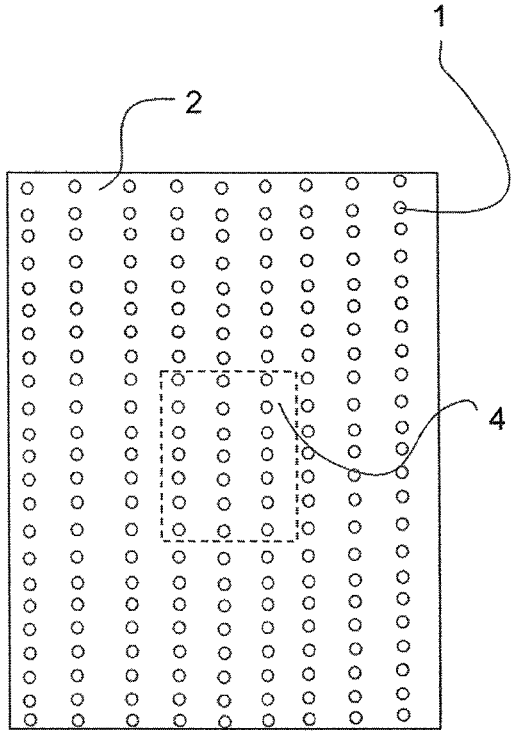
Figure 1C:
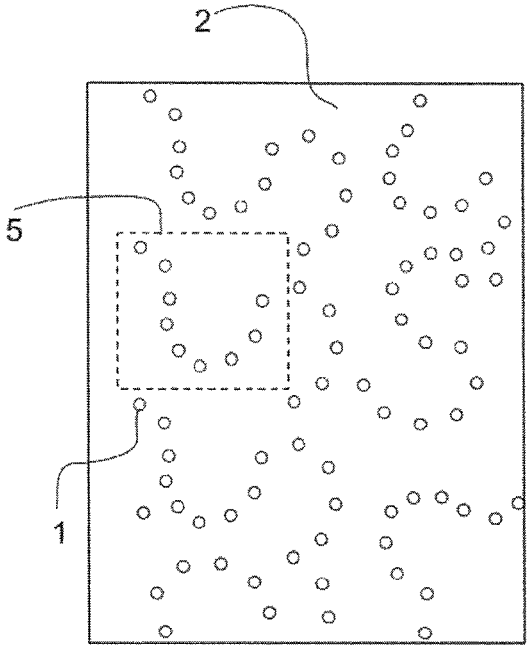
Figure 1D:
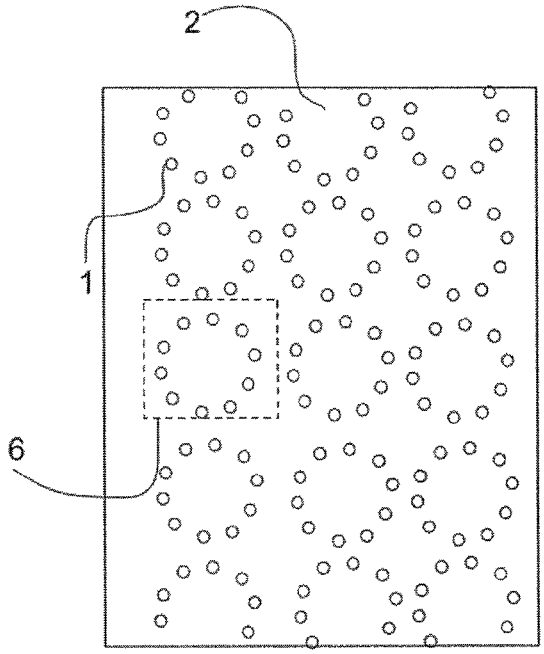
Figure 1E:
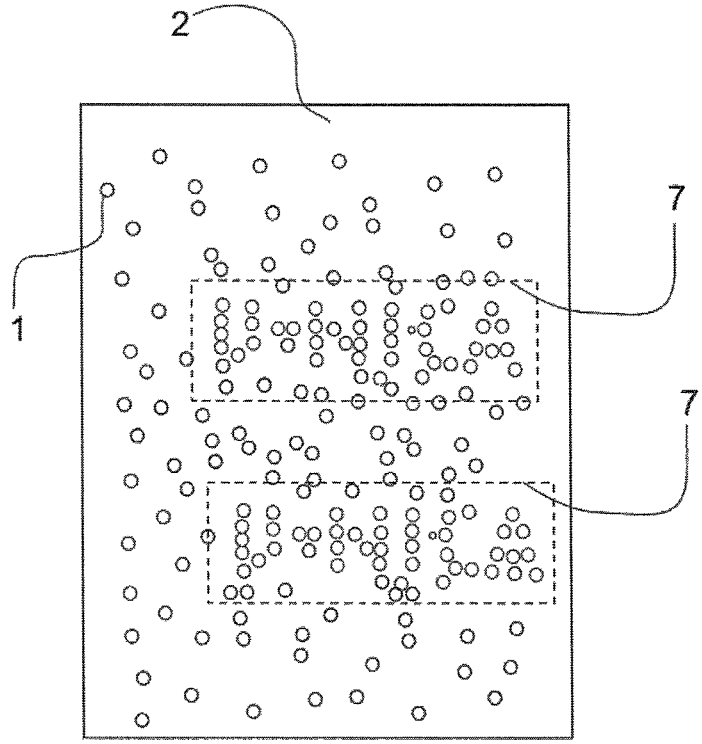

FIG. 1 shows an image area 2 occupied with pigments 1. The variant according to FIG. 1*a* shows a random, i.e. substantially statistical distribution of the pigments 3, while the other variants according to FIG. 1*b* to FIG. 1*d* show linear 4, meandering 5 or circular 6 arrangements of the pigment particles. Finally, FIG. 1*e* demonstrates superposition of a statistical distribution with a microprint 7. All these variants of pigment distribution can be produced with printing methods and can be used as starting material for carrying out the proposed method.

Figure 2A:
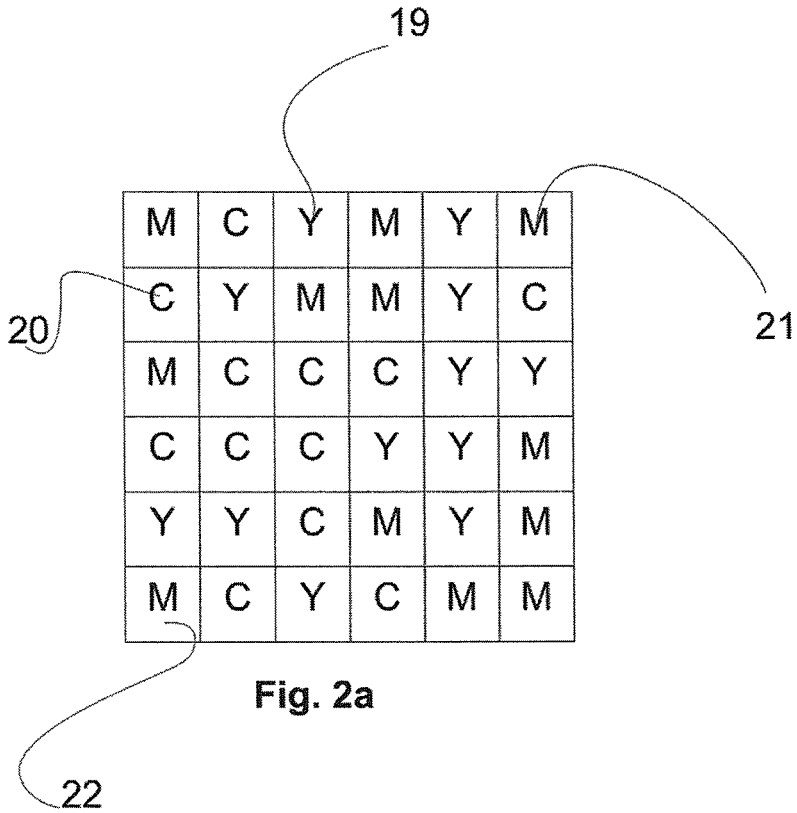
FIG. 2 shows in a) a schematic representation of the division of an area into area elements with associated pigment particles, in b) the activation of a pigment particles by a laser and in c) the diffraction-induced narrowing of the laser beam in the focal plane.
Figure 2B:
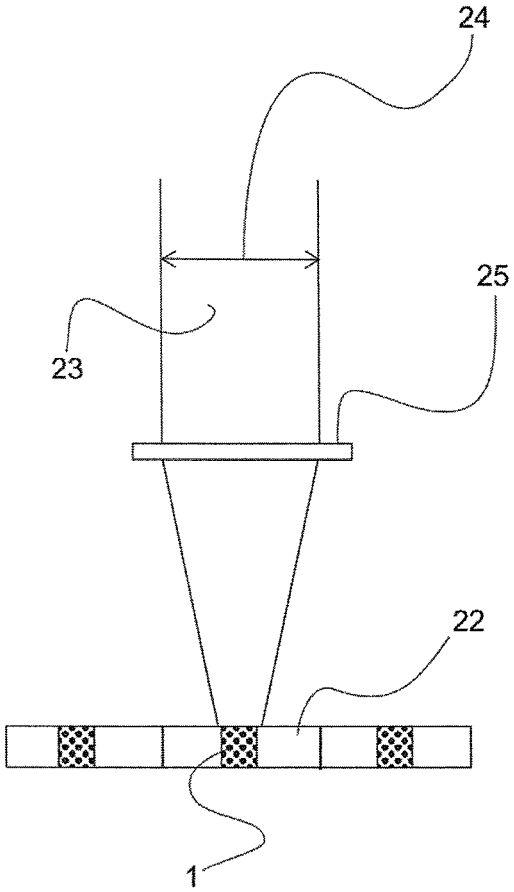
Figure 2C:
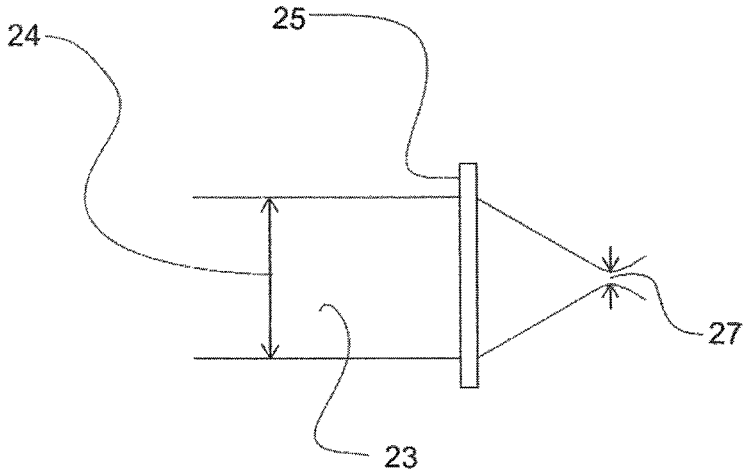

FIG. 2*a* is an abstract and schematic representation of an image area, which consists of area elements 22 which are in this case 25 theoretically imagined to a certain extent and each contain only one pigment grain. In this example, the pigment grains have the three basic colours cyan [C] 20, magenta [M] 21 and yellow [Y] 19 in a statistical distribution, but only one corresponding pigment particles in each area element. FIG. 2*b* shows the profile of a laser beam 23 with a certain beam diameter 24. After passing through a focussing element 25, this laser beam is focussed on a diameter which allows complete irradiation of a pigment grain 1, and the focus diameter of which is small enough to lighten only one pigment grain 1 in each case but irradiates the latter substantially completely over the whole effective cross section. FIG. 2*c* shows the narrowing of the laser beam 23 in the focal plane to an extremely small diameter 27 after diffraction when passing through the focussing element 25.

Figures 3A, 3B:
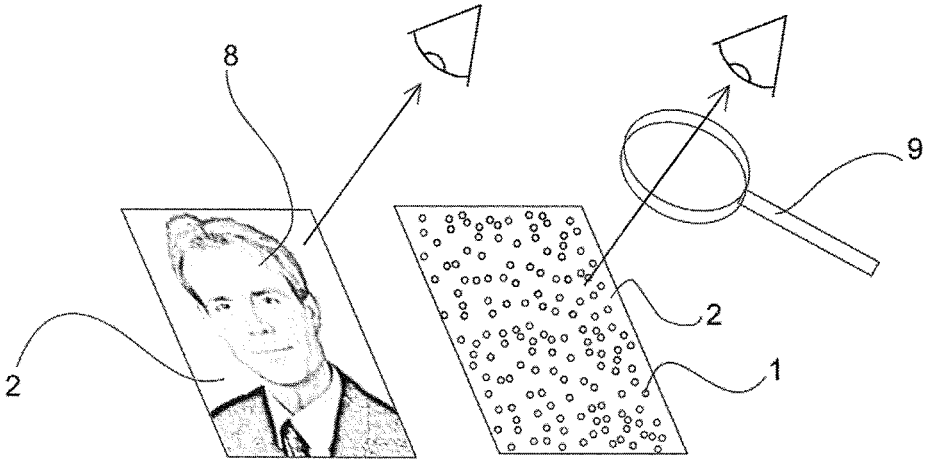
FIG. 3 shows the different appearances depending on the degree of magnification, a) showing the appearance to the naked eye and b) showing the appearance with a magnification means.

FIGS. 3*a* and 3*b* illustrate the difference between the macroscopic observation or effect of an image 8 which has been produced according to a method of this invention (FIG. 3*a*) and the microscopic observation, which allows the pigment structure to be viewed with a magnification device (FIG. 3*b*). The microscopic observation of a pigment distribution controlled in a targeted manner allows precisely this distribution to be verified, as this distribution is combined with the actual individualised information of the image, the fingerprint effect of the pigment distribution is combined with the individualising information in such a manner that a considerable improvement in the security level results. In practice, this pigment distribution can also be a specific raster, which can be assessed with a printers' loupe. A combination of a specific raster with a random background distribution is also possible, so the specific raster can be verified without reference to a database, and the random background distribution can be verified by querying the corresponding identification information in a database. The microscopic structure can thus be checked both in a simple verification method (specific raster) and in a high-level security verification method (querying the random distribution from the database).

Figures 4A, 4B:
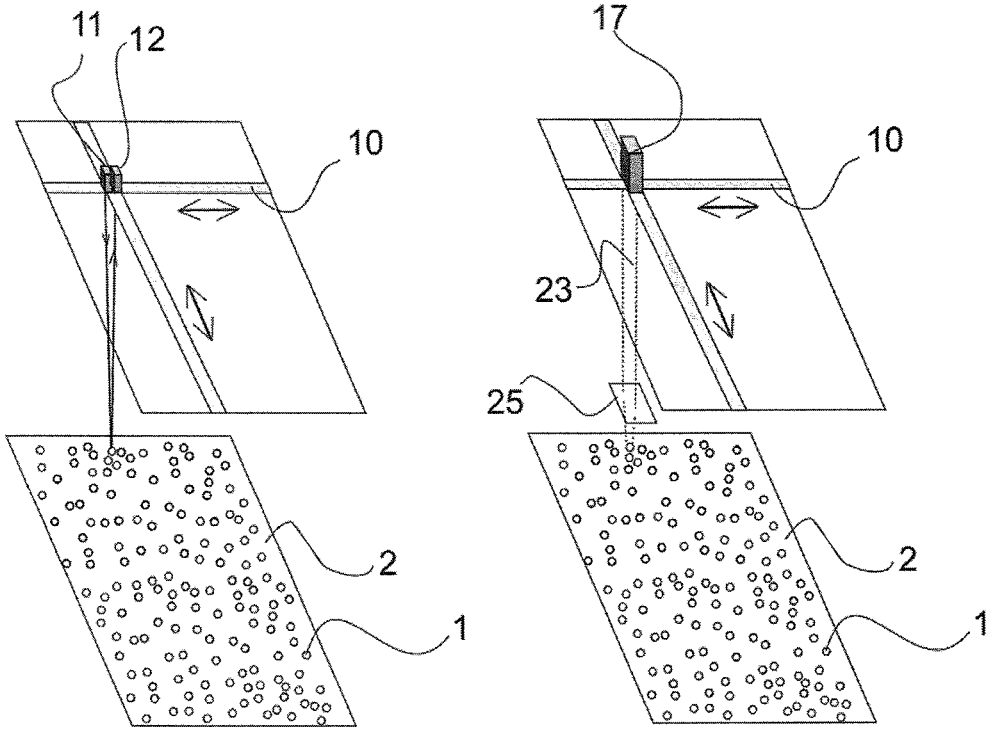
FIG. 4 shows the different steps of image production, a) showing the step of determining the position and type of the pigment particles and b) showing the local influence on the pigment particles by the laser.

The drawings FIG. 4*a* and FIG. 4*b* demonstrate the two essential method steps a and b of this invention, consisting of the spatial and spectral analysis of the pigments using reflected light with the aid of a white light source 11 and a photoreceiver 12, which can be positioned over the sample or image field in a micrometer-precise manner with a two-way linear displacement unit 10 (FIG. 4*a*, step a), and a UV laser system 17, which emits a laser beam 23 in such a manner that this laser beam can hit each individual pigment point precisely according to the data which has been obtained from the apparatus according to FIG. 4*a* (FIG. 4*b*, step b). Alternatively to the movement of the white light source and photoreceiver and laser optics shown here, the substrate can also be moved by means of a two-way displacement unit. This alternative is not shown in FIG. 4*a*/4*b*. Furthermore, it should be mentioned with reference to the illustration of the photoreceiver 12 that the structure of the photoreceiver is shown simplified. It is not shown that in the case of white light excitation the detector consists of a plurality of colour-specific components, which can consist for example of a plurality of photodiodes provided with different coloured filters, or that the detector can for example also be a CCD sensor or a CMOS sensor with an upstream multi-coloured filter (e.g. Bayer filter), it being possible to omit a colour filter in the case of a Foveon CMOS sensor. Furthermore, it is not shown in the illustration of the exciting light source 11 in FIG. 4*a* that, in the case of successive excitation with light in different colours, the excitation light is produced with a plurality of different coloured, narrow band light sources, the exciting light source therefore consists of a plurality of components. Furthermore, it should be noted with the focussing of the laser beam in FIG. 4*b* that the diameter of the laser beam 24 is collimated much more to the smallest diameter 27 by the focussing element 25 than illustrated in FIG. 4*b*, the drawing is therefore not to scale. Similarly, widening of the laser beam after emission from the laser resonator is not shown separately but is part of the UV laser system 17.

Figure 5:
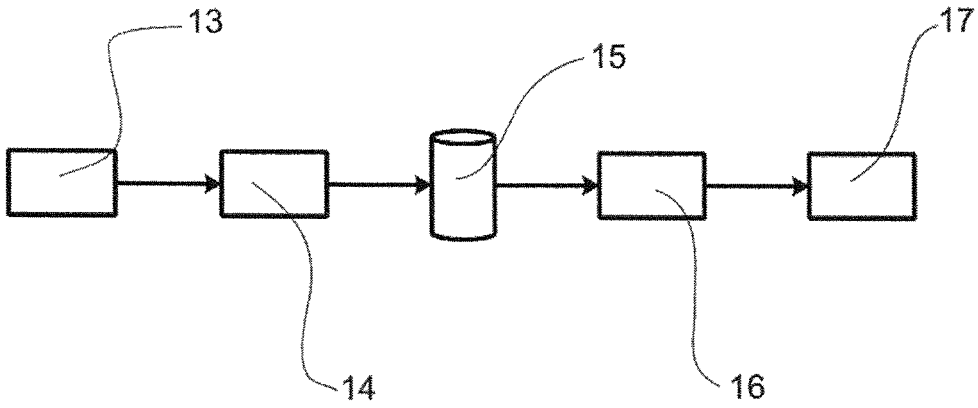
FIG. 5 shows individual steps of the proposed method in order.

The entire workflow of the method according to this invention is shown in FIG. 5. The essential steps are the spatial and colour detection of each individual pigment grain 13, production of the colour map 14, storage of the data thus obtained as a colour map in a database 15, which delivers the data or the activation protocol for the laser control system 16, which in turn controls the process of selective laser bleaching with the UV laser system 17. The colour map in the database is also used as a signature for a subsequent authentication of the security document by means of its image data.

Figure 6A:
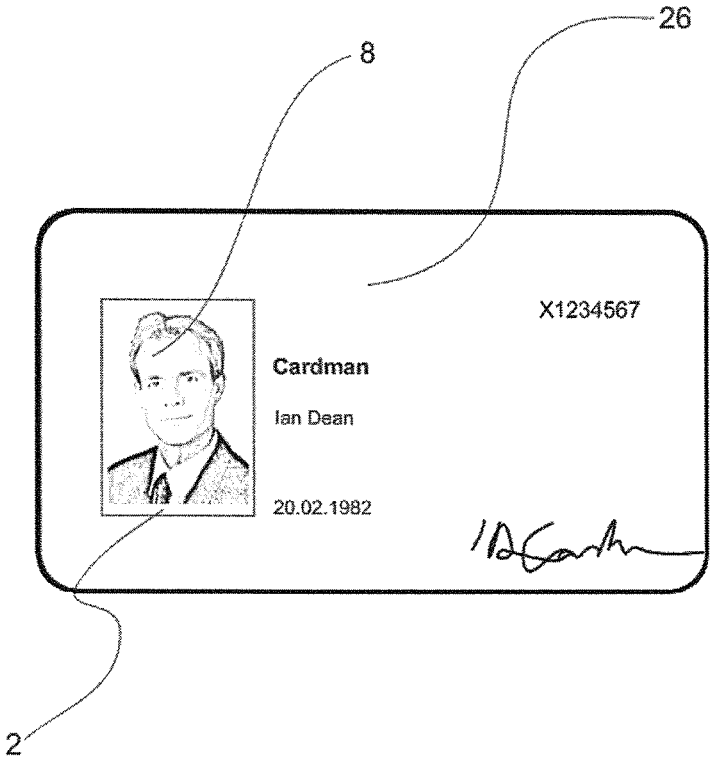
FIG. 6 shows exemplary identification cards.
Figure 6B:
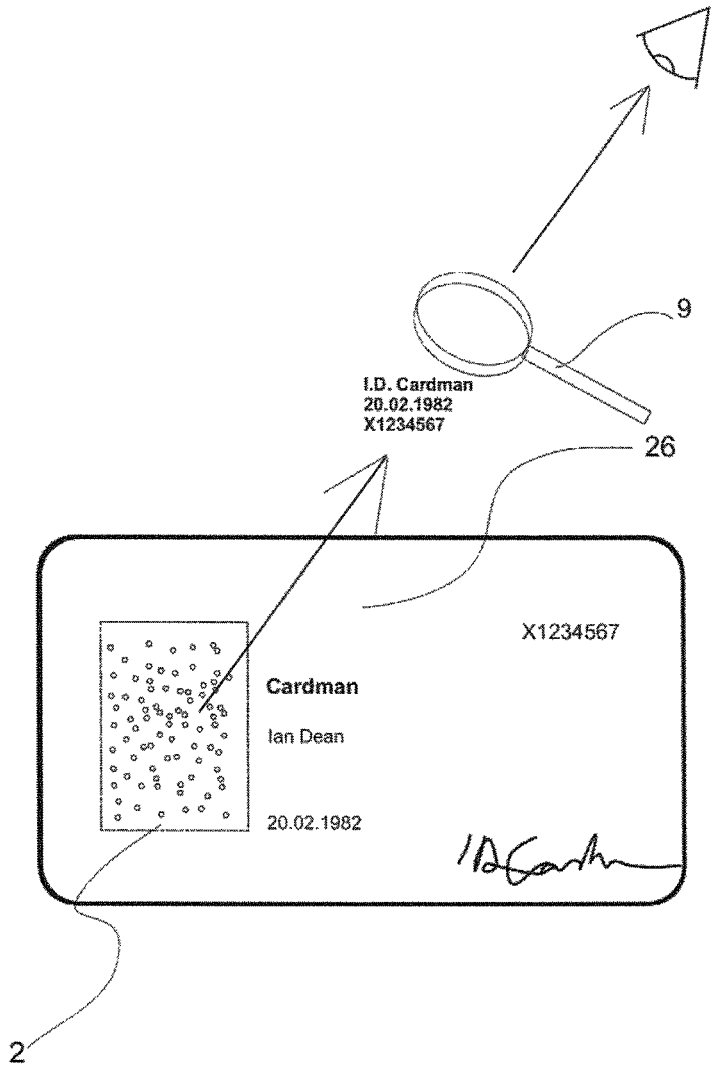

The drawings of FIGS. 6*a* and 6*b* explain a possible application of this technology for portrait production on a card-shaped data carrier 26. The portrait produced according to this invention also contains additional data which is stored on the basis of the pigment distribution in the image field 2 which is achieved by the printing of the pigments. This data can for example be personalisation data of the document owner (as shown in FIG. 6*b*), which is used to identify the document owner or also e.g. to allow authentication of the document by means of a serial number or information on the statistical distribution of the particles within a certain area etc.

Figure 7A:
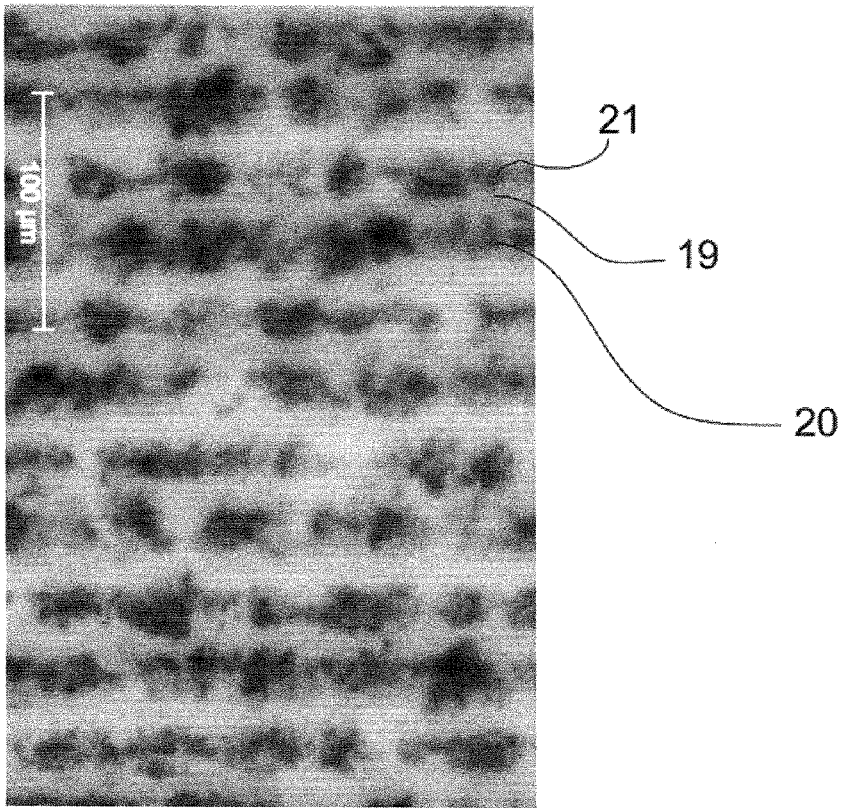
FIG. 7 shows microscopic recording of a substrate printed with coloured stripes before treatment with a laser beam (a) and a further, non-microscopic recording of an irradiated substrate with a laser at a single wavelength (b).
Figure 7B:
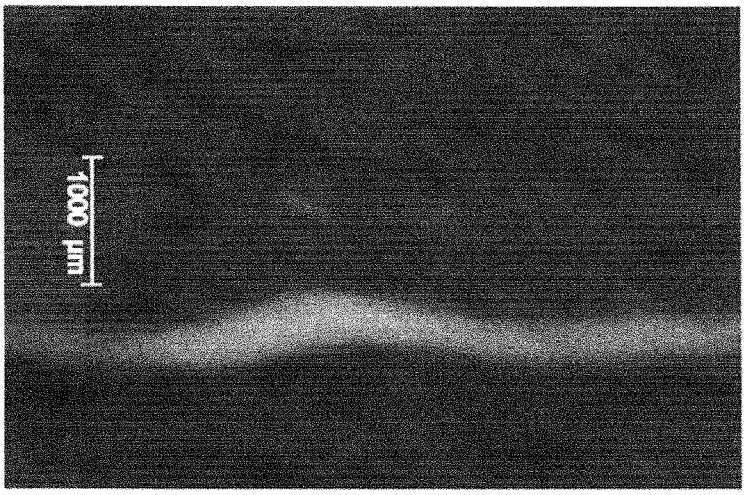

The image according to FIG. 7*a* shows a microscopic recording of a substrate which is printed with a high-resolution method and onto which the colours yellow (19), cyan (20) and magenta (21) are printed in stripe form. On the microscopic scale, the distribution of the colour shows conspicuous irregular distortions, which are attributable to deficiencies in the printing method. FIG. 7*b* shows the macroscopic representation of bleaching, produced with a 355 nm 2 W laser (free beam, unfocussed), of a colour pigment mixture consisting yellow, cyan and magenta pigments. The thickness of the stripe is approximately 500 μm. The pigments are bleached independently of their colour, a spectral selection no longer takes place at 355 nm, in contrast to the visible light range.

A: Improvement of Conventional Printing Methods:

A print master is printed with the aid of a known printing method (offset printing, intaglio printing etc.) in such a manner that a coloured printed pattern which is regular according to superficial observation and is defined by the production process is situated on the print master. The print master has all the colour parts which are necessary for the colour mixture. With a pattern of colours (19), (20) and (21) shown in stripes as in FIG. 7*a*, the colour stripes assume a width of less than 10 μm at a resolution of 500 dpi and microscopically have an irregular shape, which is attributable to the deficiencies of the printing method. The technical execution of such a precise 3-colour print has faults according to the current prior art. In particular, it does not allow operation in the entire image area without overlapping of the colour parts and with no gaps. In contrast, owing to technical deficiencies in the printing method, small offsets (passers) remain, which manifest themselves as overlaps or unprinted areas. Furthermore, the actually printed area will not be printed homogeneously owing to the warping of the slightly raised printed areas when the master is removed during mechanical production. FIG. 7*a* shows the irregular shape of the areas printed with stripes which are visible on the microscopic scale, produced with a high-resolution printing method in an impressive manner. For this reason, a method is advantageous used, which digitally detects the objective, statistically distributed defectiveness of the print, in that the arrangement is checked by means of a detector, then stored and is taken into account in the subsequent exposure. To this end, an x-y linear displacement unit with a mechanical repeat accuracy of 2 μm (e.g. manufactured by Heinrich Wolf, Eutin), is advantageously used to displace the printed substrate by in each case one microscope visual field. In this manner the entire printed area is detected. The microscope has a digital camera on its lens tube. A magnification ratio of approximately 1:3 is advantageous, because modern digital cameras can realise pixel sizes in the region of 3 μm and under (e.g. products manufactured by Point Grey). Deviations of 2 μm in the visible light range are reliably resolved by this magnification scale, without reaching the diffraction limit. After the linear displacement unit has moved over the entire print area with the aid of corresponding computer control, a copy of the actual, defective print image with the resolution of 2 μm is present in the memory. The detection of the resolution is thus higher than the resolution of the print by a factor of approximately 25 (500 dpi correspond to approximately 50 μm/pixel). The colourings used for the print can be ablated or bleached with the aid of a laser. In a second step, the colouring is ablated or bleached in a targeted manner with a suitably selected focal size. A focal diameter of less than 2 μm can be achieved with a wavelength of 355 nm which can also advantageously be used for bleaching, so the focal size can be adapted to the actually desired resolution. In this manner a resolution and colour fidelity which have not been achieved previously with conventional printing methods is achieved without the printing method itself having to be changed in any way by the combination of the high-precision detection with the precise operation of the laser. An optically induced bleaching process can also be carried out in this manner inside a laminate, as long as the layer carrying the print is covered by a transparent layer. This application possibility is particularly advantageous in the personalisation of security document blanks such as personal documents or drivers' licences. An illustration of pigments of different colours which are bleached with a UV laser at a wavelength of 355 nm is shown in FIG. 7*b*.

B: Considerable Improvement in Security Against Forgery in Conventional Printing Methods:

In this case, work is carried out mainly according to embodiment A. The method is used to personalise for example security documents, and it opens up an additional possibility for greatly improving security against forgery. In this use example, the precise detection of the colour areas is no longer merely used to improve the printing method in terms of its technical deficiencies as above. The fact that it is not necessary to know the arrangement of the stripes or patterns before personalisation of the blank is also exploited. The arrangement of the colours can also take place in a random pattern, changing from blank to blank, as this can be detected by the corresponding control unit. A blank can thus only be printed if the method according to a. is used before exposure to the laser, as otherwise an incorrect colour representation would occur. Thus, blanks cannot be used for forgery as long as the forger does not use a microscopic analysis according to method a. A particular possibility of making a forgery immediately recognisable even to the untrained eye consists in also changing the regularity of the pseudostatistical mixture of the colour pattern, for instance in personal papers, for instance in the area in which the forehead of the portrait usually comes to lie in such a manner that the incorrect colour representation changes and for instance the word "forgery" appears legibly in colour if the precise microposition of the colour pattern is not taken into account.

C: Improvement of Specific Printing Methods:

According to WO-A-01 15910, it is possible to produce the colour effect of pigment mixtures consisting of yellow, cyan and magenta pigments selectively by irradiating them at the wavelengths of a laser which are complementary to the pigment colour and thus bleaching them. A red, green and blue laser are thus necessary for the complete exposure. With this method there is always a plurality of pigment grains of different colour within the focus of the laser beam, which at the same time corresponds to the desired pixel size, that is, approximately 50 μm for a resolution of 500 dpi, as the pigment grains are much smaller. However, only precisely the pigments which absorb the laser radiation of the wavelength used in each case are always bleached. Yellow pigments therefore absorb the blue wavelength and thereby bleach out. The other cyan and magenta pigments remaining in their colour mix subtractively to form blue when observed under reflecting light. Blue irradiation therefore produces a blue hue. The same happens with red and green laser radiation when it meets the same pigment mixture. In this embodiment, the grain sizes of the pigments are in the region of 10 μm. They therefore have the same order of magnitude as the stripes in embodiments A and B. Accordingly, they can be detected in their position to an accuracy of 2 μm with a microscopic scanning method in the same manner as described there. Their diameter is also suitable to address them individually with a UV laser beam with a focus of approximately 10 μm, as the mentioned mechanical linear displacement units with a position accuracy of 2 μm can be obtained commercially (manufactured by Heinrich Wolf, Eutin). It can be seen in FIG. 7*b* that all 3 types of pigment are bleached at only one wavelength in the UV range (typically 355 nm). This embodiment thus opens up the possibility of working with only one laser instead of with lasers, as the individual colour constituents of the pigments are no longer addressed via the wavelength of the light but via the location. The transition to only one wavelength thus achieves a considerable reduction in the cost of the technical system. At the same time, the combination with embodiment B can result in the positions of all the pigment grains not only being known but also stored permanently. This also allows an authenticity check of extremely high security against errors, as it is virtually impossible to adjust the distribution of the pigment grains. The security against errors is so high that should be sufficient in everyday use, for example at border controls, to photograph only small sections of an image with for example a cost-effective USB microscope and to carry out a first authenticity check by a central server. The whole image would only be used in case of doubt.

LIST OF REFERENCE SYMBOLS

1 Pigment particles
2 Substrate, image area
3 Area with statistical distribution of the pigment particles
4 Area with regular distribution of the pigment particles, linear
5 Area with regular distribution of the pigment particles, meander
6 Area with regular distribution of the pigment particles, circular arrangements
7 Area with regular distribution of the pigment particles, microprint
8 Image, symbol, legend
9 Magnification device, loupe
10 x/y linear displacement unit
11 White light source
12 Light sensor, photoreceiver
13 Detection of the pigment particles as a colour element as a function of the location coordinates
14 Storage of data as a colour map
15 Storage in a database
16 Laser control
17 Laser bleaching
17 UV laser system
19 Area element with pigment particles of basic colour yellow
20 Area element with pigment particles of basic colour cyan
21 Area element with pigment particles of basic colour magenta
22 Area element
23 Laser beam
24 Beam diameter of 23
25 Focussing element for example lens, grid
26 Card-shaped data carrier
27 Diameter of laser beam

The invention claimed is:

1. A method for producing a multi-coloured character, pattern, symbol or image on a substrate having pigment particles which are arranged thereon, wherein the pigment particles lose or change their colour effect under the action of a laser, wherein different pigment particles having at least two different colour effects are arranged on or in the substrate, wherein the pigment particles are distributed substantially randomly as a function of the location coordinates, wherein the method comprises the following method steps:

a producing a colour map, in which the individual colour effect of individual pigment particles or individual clusters of pigment particles is contained as a function of the location coordinates thereof on or in the substrate;

b spatially resolved irradiating of the substrate with a laser at a single frequency adapted to only change the colour effect of individual pigment particles or individual clusters of pigment particles in their colour effect on the basis of the colour map to produce a resulting colour effect.

2. The method according to claim 1, wherein steps a and b are carried out in the same device and without manipulation or displacement of the substrate taking place in between.

3. The method according to claim 1, wherein the different pigment particles are arranged in at least one layer in the substrate.

4. The method according to claim 1, wherein the different pigment particles are arranged in a single layer on the substrate.

5. A method for producing a multi-coloured character, pattern, symbol or image on a substrate having pigment articles which are arranged thereon wherein the pigment particles lose or change their colour effect under the action of a laser, wherein different pigment particles having at least two different colour effects are arranged on or in the substrate, wherein the pigment particles are distributed substantially regularly as a function of the location coordinates, wherein the method comprises the following method steps:

a producing a colour map, in which the individual colour effect of individual pigment particles or individual clusters of pigment particles is contained as a function of the location coordinates thereof on or in the substrate;

b spatially resolved irradiating of the substrate with a laser at a single frequency adapted to only change the colour effect of individual pigment particles or individual clusters of pigment particles in their colour effect on the basis of the colour map to produce a resulting colour effect, wherein the different pigment particles are arranged in at least one layer in the substrate and are substantially arranged regularly in a microscopic pattern, wherein the microscopic pattern can be an arrangement of straight or waved lines, basic patterns or microprint.

6. A method for producing a multi-coloured character, pattern, symbol or image on a substrate having pigment articles which are arranged thereon, wherein the pigment particles lose or change their colour effect under the action of a laser, wherein different pigment particles having at least two different colour effects are arranged on or in the substrate, wherein the pigment particles are distributed substantially regularly as a function of the location coordinates, wherein the method comprises the following method steps:

a producing a colour map, in which the individual colour effect of individual pigment particles or individual clusters of pigment particles is contained as a function of the location coordinates thereof on or in the substrate;

b spatially resolved irradiating of the substrate with a laser at a single frequency adapted to only change the colour effect of individual pigment particles or individual clusters of pigment particles in their colour effect on the basis of the colour map to produce a resulting colour effect, wherein the different pigment particles are arranged in a layer on the substrate and are substantially arranged regularly in a microscopic pattern, wherein the microscopic pattern can be an arrangement of straight or waved lines, basic patterns or microprint.

7. The method according to claim 1, wherein the individual pigment particles have an average diameter in the range 5-15 μm and that they are arranged substantially on the substrate or in the substrate.

8. The method according to claim 1, wherein the individual pigment particles are arranged substantially on the substrate or in the substrate with a lateral separation between them.

9. The method according to claim 8, wherein the individual pigment particles are arranged with a lateral separation between them in such a manner that the normal projection of the average spacing into the printing layer plane between two pigment particles is equal to or greater than the average diameter of the pigment particles.

10. The method according to claim 1, wherein the beam diameter of the laser beam in step b is no more than twice the size of the average diameter of the pigment particles.

11. The method according to claim 10, wherein the beam diameter of the laser beam in step b is in the range 5-20 μm.

12. The method according to claim 11, wherein the beam diameter of the laser beam in step b is in the range 8-15 μm.

13. The method according to claim 1, wherein, in order to carry out step a, the surface of the substrate is scanned with a displacement unit having a white light source and detection unit arranged in the vicinity, wherein as a function of the location coordinates, white light or a sequence of light flashes of different colours is irradiated and the reflected or transmitted light is spectrally analysed as a function of the location coordinates, allowing a distinction between the different pigment particles arranged in or on the substrate, and wherein the position and the colour effect of individual pigment particles or clusters of individual pigment particles or clusters of pigment particles are recorded as a data tuple in a data matrix forming the colour map.

14. The method according to claim 13, wherein the displacement unit is a linear displacement unit.

15. The method according to claim 1, wherein the spatially resolved irradiating of the substrate with the laser causes a signal, and wherein the signal is determined at at least two discrete frequencies, which allow a distinction between the different pigment particles arranged in or on the substrate, using a photodiode.

16. The method according to claim 1, wherein, in order to carry out step b, the surface of the substrate is scanned, using a displacement unit with a laser source arranged in the vicinity, wherein the laser source is directed at individual pigment particles or clusters of pigment particles on the basis of the colour map, in order to destroy or activate the colour effect thereof individually.

17. The method according to claim 1, wherein, in order to carry out step b, the laser optics are fixed in position and the substrate is moved with the aid of a linear displacement unit in such a manner that the laser source passes over the substrate on the basis of the colour map and the laser beam meets individual pigment particles or clusters of pigment particles in order to destroy their colour effect individually.

18. The method according to claim 1, wherein, proceeding from the colour map determined in step a for the character, pattern, symbol and/or image, a processing protocol for the laser is produced in a data processing unit in step b, wherein the said processing protocol receives the information on which individual pigment particles are to be locally influenced in their colour effect by the laser in a targeted manner, in particular destroyed in their colour effect by the laser, as a function of the location coordinates to produce a certain macroscopic colour effect for the character, pattern, symbol and/or image.

19. The method according to claim 1, wherein the laser used in step b is a UV laser.

20. The method according to claim 1, wherein in the case of a defective or absent assessment of the colour map for the control of the laser, a microscopic recognizable pattern appears on a data carrier, which indicates a forgery or that the image is defective.

21. A data carrier having a character, pattern, symbol and/or image produced by a method according to claim 1, wherein the character, pattern, symbol and/or image has been produced on the basis of a substrate with a random arrangement of the pigment particles, and that the random arrangement and its use for producing the character, pattern symbol and/or image is stored on the data carrier and/or in a database to increase security.

* * * * *